US006428063B1

(12) United States Patent
Bland

(10) Patent No.: US 6,428,063 B1
(45) Date of Patent: Aug. 6, 2002

(54) VEHICLE DOOR LATCH

(75) Inventor: Timothy Bland, Evesham (GB)

(73) Assignee: Meritor Light Vehicle Systems Ltd., Birmingham (GB)

( * ) Notice: Subject to any disclaimer, the term of this patent is extended or adjusted under 35 U.S.C. 154(b) by 0 days.

(21) Appl. No.: 09/402,291

(22) PCT Filed: Mar. 30, 1998

(86) PCT No.: PCT/GB98/00943

§ 371 (c)(1),
(2), (4) Date: Nov. 30, 1999

(87) PCT Pub. No.: WO98/44226

PCT Pub. Date: Oct. 8, 1998

(30) Foreign Application Priority Data

Apr. 2, 1997 (GB) ..... 9706704

(51) Int. Cl.[7] ..... E05B 17/00

(52) U.S. Cl. ..... 292/346; 292/337; 292/DIG. 65; 292/216; 292/DIG. 23; 292/DIG. 41

(58) Field of Search ..... 292/346, DIG. 65, 292/337, 216, DIG. 23, DIG. 41

(56) References Cited

U.S. PATENT DOCUMENTS

| | | | | |
|---|---|---|---|---|
| 4,281,478 A | | 8/1981 | Inami | |
| 4,580,823 A | | 4/1986 | Yamada et al. | |
| 5,382,062 A | | 1/1995 | Kostler | |
| 5,505,506 A | * | 4/1996 | Kleefeldt | 292/337 |
| 6,042,160 A | * | 3/2000 | Hamada et al. | 292/216 |

FOREIGN PATENT DOCUMENTS

| | | |
|---|---|---|
| DE | 32 40 532 | 5/1984 |
| EP | 0 098 560 | 1/1984 |
| FR | 2 372 067 | 6/1978 |
| FR | 2 691 997 | 12/1993 |
| GB | 270939 | 5/1927 |
| GB | 1 561 538 | 2/1980 |
| GB | 2 031 052 | 4/1980 |

OTHER PUBLICATIONS

Patent Abstract of Japan, vol. 8, No. 166 (M–314), Aug. 2, 1984 & JP 59 063222, Apr. 10, 1984; see Abstract.

* cited by examiner

*Primary Examiner*—Anthony Knight
*Assistant Examiner*—Matthew E. Rodgers
(74) *Attorney, Agent, or Firm*—Marshall & Melhorn, LLC

(57) ABSTRACT

Latch assembly for a vehicle door 10 (FIG. 1) hinged at its leading edge has an L-shaped housing plate 20 to be secured in the trailing inside edge comer of the door and carrying latch mechanism. Inner skin 14 of the door is cut away to admit a striker 18 into a mouth of the plate for engagement by the mechanism to keep the door shut. A projecting abutment rib 28 of the plate adjacent the mouth prevents or resists rearward displacement of the trailing edge of skin 14 which could otherwise obstruct the mouth in the event of impact damage to the door.

3 Claims, 1 Drawing Sheet

VEHICLE DOOR LATCH

BACKGROUND OF THE INVENTION

This invention relates to latches for hinged driver's and passenger doors in vehicle bodies.

SUMMARY OF THE INVENTION

The object of the invention is to provide a latch assembly for such doors which enhances s safety by reducing the likelihood of doors being rendered difficult to open following an accident. A further object is to facilitate the mounting of said assembly on the door.

According to one aspect the invention provides a latch assembly as defined by claim 1 of the appended claims.

According to another aspect the invention provides a latch assembly as defined by claim 4 thereof.

According to another aspect the invention provide s the combination of a vehicle access door and a latch assembly as defined by the above referenced claims.

An example of the invention is now more particularly described with reference to the accompanying drawings wherein:

DESCRIPTION OF THE PREFERRED EMBODIMENTS

A car or other light vehicle body has one or more driver and/or passenger side access doors of conventional construction hinged at their leading edges relative to normal forward travel of the vehicle. Each door is releasably secured by a respective latch assembly housed in a trailing edge part of the door and including latch mechanism of known construction coacting with a respective striker mounted on the door pillar or other fixed structure of the body surrounding the door opening.

Figure 1:
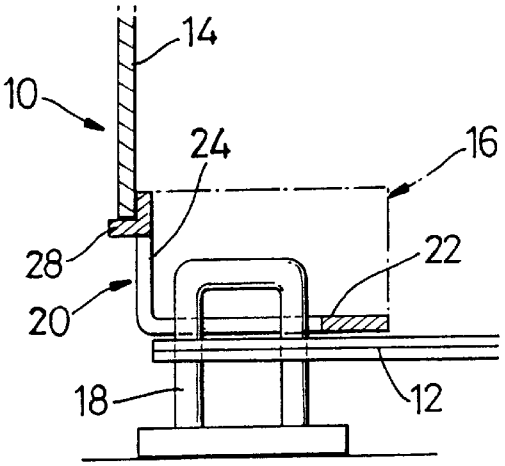
FIG. 1 is a diagrammatic horizontal section of part of a door, mounted latch assembly, and associated striker in normal closed condition.
Figure 2:
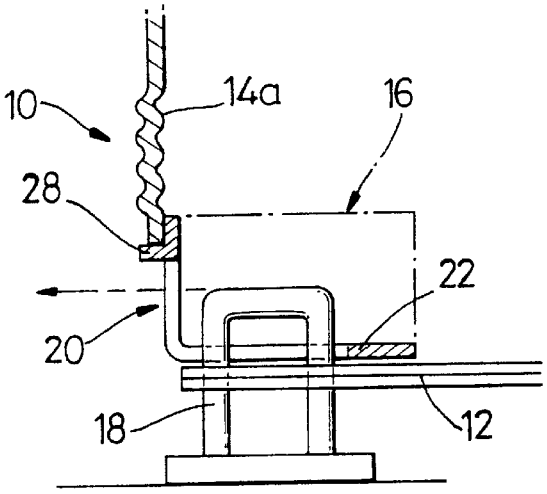
FIG. 2 by an equivalent section following distortion of the door due to an accident.

A small part only of one said door is shown in FIGS. 1 and 2, this part being the inward-facing corner of the trailing edge part of the door.

Door 10 is fabricated from sheet metal pressings to form a generally hollow structure including an outer facing skin (not shown) to the outside of the body, a trailing edge flange 12 extending inwardly generally normal to the outer skin at or near the trailing edge of the latter and an inner skin 14 in generally spaced parallel relationship to the outer skin and usually carrying a detachable trim panel (not shown) covering the inner face of the door.

A generally box-shaped unitary latch assembly 16 containing the latch mechanism (not shown) is operatively secured in said inner corner of door 10. Part of inner skin 14 cut away to leave an opening allowing the striker 18 to enter the latch assembly 16 as door 10 is swung closed, moving to the left as viewed in the drawings.

Figure 3:
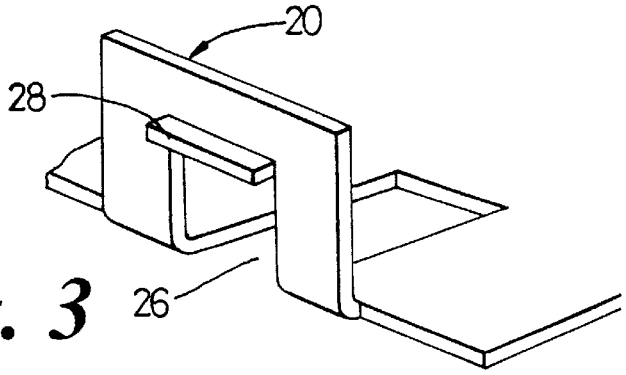
FIG. 3 is a perspective view of part of a retention plate of said latch assembly.

Latch assembly 16 includes a heavy gauge pressed metal retention plate 20 part of which is shown in greater detail in FIG. 3 forming part of the housing of the latch assembly enclosing and mounting the mechanism thereof, and with other parts of the housing, securing the latch assembly in the door.

Plate 20 is L-shaped in horizontal section, its major limb 22 being overlain by the trailing edge flange 12 and its minor limb 24 extending forwardly along the inner face of door 10 to be overlapped at its leading edge by the trailing edge of the cutaway part of inner skin 14.

The corner angle of plate 20 is cut away in its central region to define a mouth 26 for free entry of striker 18 as the door closes.

In this example, striker 18 is a loop or staple formed from metal rod and it is engaged by a bolt (not shown) in the form of a rotating claw of the latch mechanism as is well known in the art, the claw in turn being engaged by a pawl of the mechanism which keeps the door safely closed until released.

The foremost side of mouth 26 is bounded by an abutment rib 28 pressed as part of plate 20 to project outwardly of the mouth, ie towards the inside of the vehicle body with the door closed and, on assembly, the trailing edge of the cut away part of inner skin 14 locates against this rib.

If door 10 should be distorted due to impact or other accident, and particularly if the vehicle is involved in a "shunt" or head-on or rear collision tending to compress the body longitudinally, the relative rigid forward and. trailing edge parts of the door in abutment with the door framed verticals, will tend to be compressed together.

If abutment rib 28 was not present such compression would cause inner skin 14 to be displaced rearwardly relative to other parts of the door structure and, in particular, latch assembly 16 so that it would overlie mouth 26 and block or resist easy opening of the door because striker 18 will then be trapped within the latch assembly. This could prevent the occupants of the vehicle escaping with serious consequences due to fire risk etc and may delay access by outside rescuers in forcing the door open.

By the use of the invention, the abutment rib 28 prevents or makes less likely the displacement of the relevant edge part of inner skin 14 across mouth 26. Instead, the edge part of that skin will be forced to crinkle and concertina lengthwise as indicated at 14*a* in FIG. 2, leaving mouth 26 unobstructed to ease opening of the door.

Whilst the construction shown in the drawings is preferred in that retention plate 20 can be very readily and economically formed with abutment rib 28 by simple pressing operation, the rib being provided by displacing part of the plate which would otherwise occupy mouth 26, other constructions are contemplated. The abutment could be formed or otherwise provided on other parts of the latch body on or adjacent the leading edge of the mouth and could have shapes other than the rectilinear rib 28 illustrated.

Figure 4:
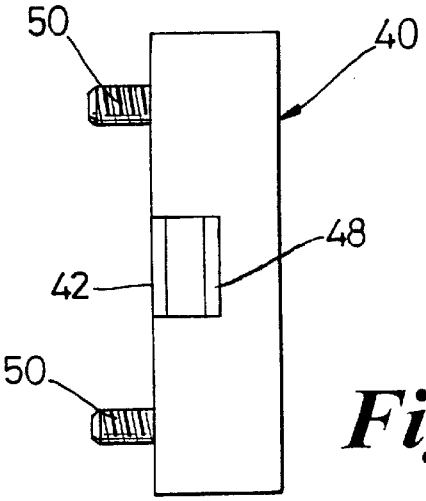
FIG. 4 is an end view of another form of retention plate.

FIG. 4 illustrates a retention plate 40 of substantially the same form as plate 20 above and which includes an abutment rib 48 in the same manner as rib 28. To facilitate assembly and securing of the latch assembly including plate 40 to the door structure said plate is provided with one or more fixed threaded studs 50 projecting from the outer face of its major limb 42.

Studs 42 are received in mating bores in the trailing edge flange 12 (FIGS. 1 and 2) of the door and secured by nuts. The stud or studs 42 can be pre-positioned anywhere on limb 42 to suit the door shape and for most effective location and attachment of the latch assembly without interfering with the internal elements of the assembly as they do not project into the inside of the housing thereof. Mounting of the latch assembly is also facilitated as studs 42 are fast with retention plate 40, there are no loose bolt or screws needing insertion and engagement for tightening.

What is claimed is:

1. A latch assembly for a vehicle side access door hinged at its leading edge, said assembly including a latch mounting body to be operatively secured in a trailing edge part of the door and defining a mouth for entry of a door post or frame mounted striker when the door is closed; characterised in that said body includes an abutment formation edging or adjacent to the operatively foremost side of the mouth and projecting from the body immediately rearwardly of an edge part of an inner skin of the door, the inner skin overlying part of the body in use, whereby rearward displacement of said skin edge part relative to the body due to impact or other damage which would cause it to overlie and obstruct said mouth is prevented or resisted.

2. An assembly as claimed in claim 1, wherein said body is box-shaped and includes an L-shaped retention plate, said mouth being formed as a cutaway in the corner angle of the plate and the abutment formation being a rib pressed outwardly of the leading edge of the mouth.

3. An assembly as claimed in claim 1, characterised in that said body includes a retention plate forming part of the body wall and defining said mouth at least in part, said plate being provided with one or more pre-positioned fixed threaded studs projecting from an outer face there of operatively securing the assembly to the door.

* * * * *